United States Patent [19]

Voelz

[11] Patent Number: 4,664,270

[45] Date of Patent: May 12, 1987

[54] AIR TRANSPORTABLE GANTRY TYPE CRANE

[75] Inventor: Richard F. Voelz, Butler, Wis.

[73] Assignee: Renner Manufacturing Company, Milwaukee, Wis.

[21] Appl. No.: 540,027

[22] Filed: Oct. 7, 1983

[51] Int. Cl.[4] ..... B66C 19/02

[52] U.S. Cl. ..... 212/175; 212/182; 212/208; 212/218

[58] Field of Search ..... 212/175, 182, 205, 208, 212/218–220

[56] References Cited

U.S. PATENT DOCUMENTS

| | | | |
|---|---|---|---|
| 2,363,784 | 11/1944 | Gerich | 212/182 |
| 2,995,094 | 8/1961 | Wallace | 212/208 |
| 3,236,392 | 2/1966 | Lamer et al. | 212/218 |
| 3,490,385 | 1/1970 | Gibbins et al. | 212/219 |
| 3,645,406 | 2/1972 | Brazell | 212/220 |

*Primary Examiner*—Joseph F. Peters, Jr.
*Assistant Examiner*—Stephen P. Avila
*Attorney, Agent, or Firm*—Fred Wiviott

[57] ABSTRACT

An air transportable gantry-type crane has a pair of collapsible side frames adapted to be releasably interconnected by a pair of elongate cross members. Each side frame has an extended operating state and a collapsed transportable state. One of the cross members includes relatively short transversely extending coupling members adapted to interconnect the side frames for maintaining the same in closely spaced parallel relation. Each side frame is also provided with wheels and a support for supporting each side frame when disconnected from the cross members.

15 Claims, 7 Drawing Figures

AIR TRANSPORTABLE GANTRY TYPE CRANE

BACKGROUND OF THE INVENTION

This invention relates to straddle type mobile cranes and more particularly to a straddle type mobile crane which may be collapsed for air transportability.

Straddle type mobile cranes are commonly employed for lifting and moving large bulky objects, such as shipping containers, structural members, heavy machinery and equipment, and the like. Such devices are well known and generally include a pair of side frames which are interconnected to cross members. The side frames commonly include a wheel or truck assembly at its opposite ends and an engine to provide motive and steering power. In addition the cross members are provided with trolleys which are interconnected with the engine for supporting and elevating the load. In order to accommodate the relatively large loads being handled, the space between the side frames and below the cross members is relatively large. Because of the size of such mobile type cranes, they must be substantially disassembled for air transport which is a requisite when employed for military purposes. The disassembly and reassembly of prior art gantry type cranes was relatively time consuming and requires a substantial number of personnel.

SUMMARY OF THE INVENTION

It is an object of the invention to provide a new and improved air transportable gantry type crane.

Another object of the invention is to provide an air transportable gantry type crane with is readily collapsible.

A further object of the invention is to provide an air transportable gantry type crane which may be collapsed in a relatively short time and requires a minimum of personnel and equipment.

Another object of the invention is a collapsible gantry type crane which is mobile in both its operating and collapsed states.

These and other objects and advantages of the present invention will become more apparent from the detailed description of the preferred embodiment taken with the accompanied drawings.

In general terms, the invention comprises an air transportable mobile gantry crane and has a pair of side frames, each of which includes a collapsible frame portion having an operating position wherein its upper end is elevated and a collapsed transport position wherein its upper ends are lowered. Elevating means is provided for moving the collapsible frame portions between their elevated and collapsed positions. First and second cross connecting means are adapted to be releasably connectable to the side frames for joining the same in spaced apart relation. The first cross connecting means is relatively elongated to provide a substantial spacing between the side frames during normal operation and when the collapsible frame portions are extended. The second cross connecting means is relatively short so that the side frames can be joined in close proximity to permit loading upon an aircraft when the collapsible frame portions are collapsed.

DETAILED DESCRIPTION OF THE PREFERRED EMBODIMENT

Figure 1:
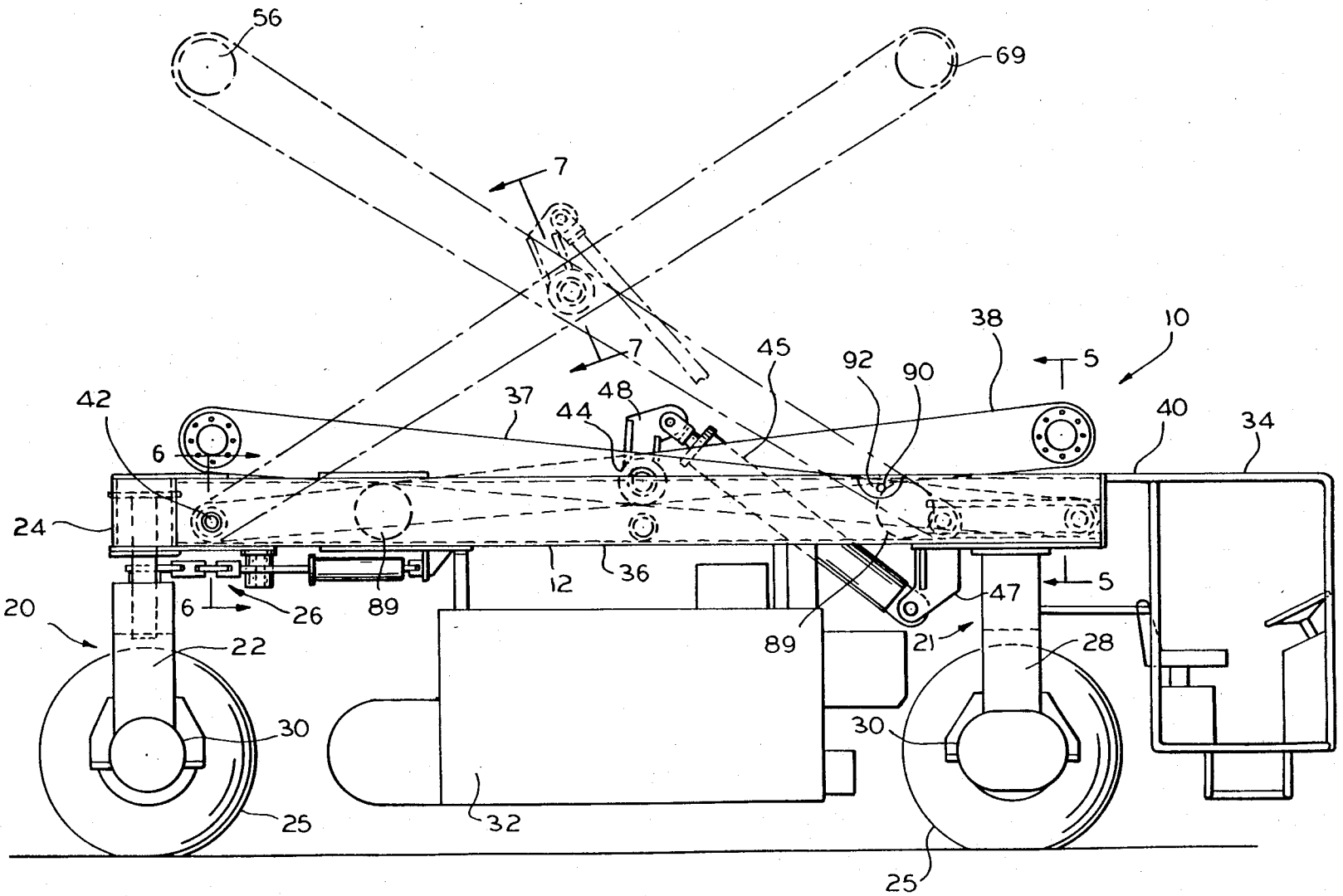
FIG. 1 is a side elevational view of the gantry type crane according to the preferred embodiment of the invention.
Figure 2:
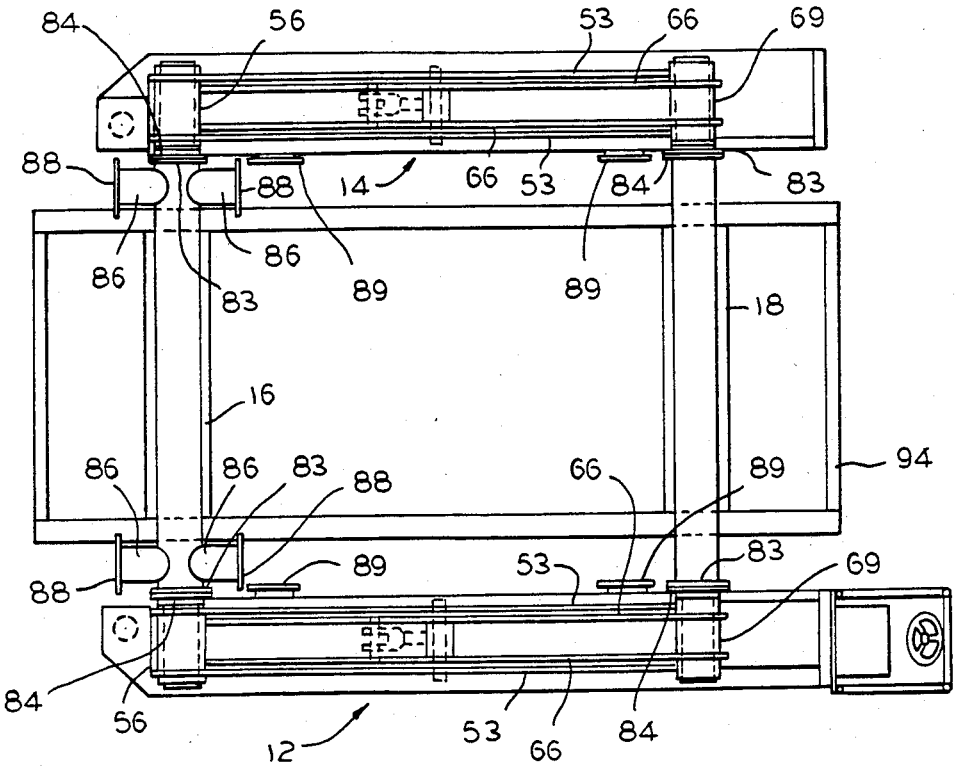
FIG. 2 is a top plan view of the gantry crane shown in FIG. 1.
Figure 3:
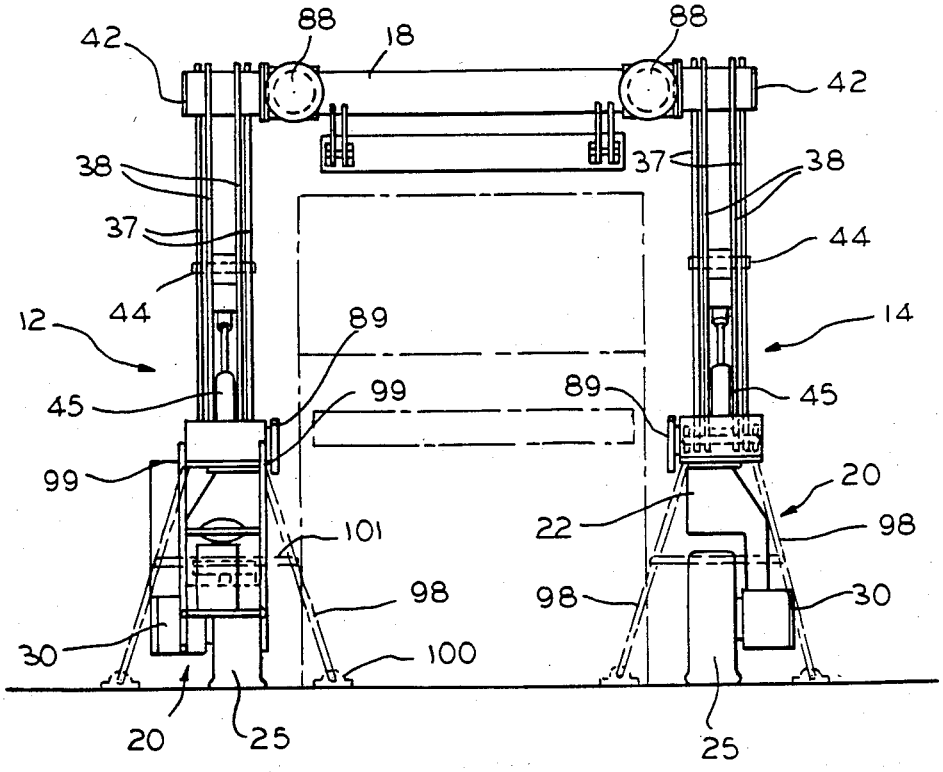
FIG. 3 is a front elevational view of the crane shown in FIG. 1.

Referring to FIGS. 1, 2 and 3, the air transportable gantry crane 10 in accordance with the preferred embodiment of the invention includes a pair of side frames 12 and 14 and a pair of elongate interconnecting members 16 and 18. Truck assemblies 20 and 21 are mounted respectively at the forward and rear ends of each side frame 12 and 14. Each rear truck assembly 20 includes a yoke 22 pivotally mounted in a bearing 24 affixed to the forward end of the side frames 12 and 14 and a wheel 25 is rotatably mounted adjacent the lower end of each yoke 24. A steering assembly 26 is supported below each side frame 12 and 14 and each is connected to one of the yokes 22 to permit the wheels 20 to be turned through an angle of up to 90 degrees. The steering assemblies 26 form no part of the present invention and accodingly will not be described in detail. For a more complete description of such a steering mechanism reference is made to application Ser. No. 211,410, filed Nov. 28, 1980, and assigned to the assignee of the present application.

Each of the front trucks 21 also includes a wheel 25 rotatably mounted on a yoke 28 which is fixedly mounted at its upper end of its respective side frame 12 or 14. The gantry may be driven in any suitable manner, such as by means of a hydraulic motor 30 mounted on each of the wheels 25. Each of the motors 30 is connected to a hydraulic control and power plant 32 which is suspended below the side frame 12. Also mounted at the forward end of the side frame 12 is an operator cab 34. The motors 30, the hydraulic control and power plant 32 and the operator cab 34 are conventional and will not be discussed in detail.

Figure 6:
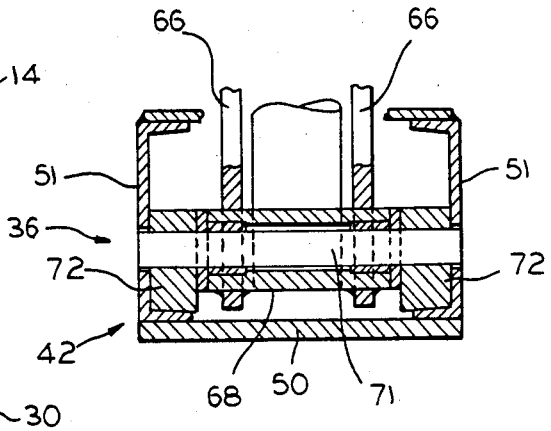
FIG. 6 is a view taken along lines 6—6 of FIG. 1.
Figure 5:
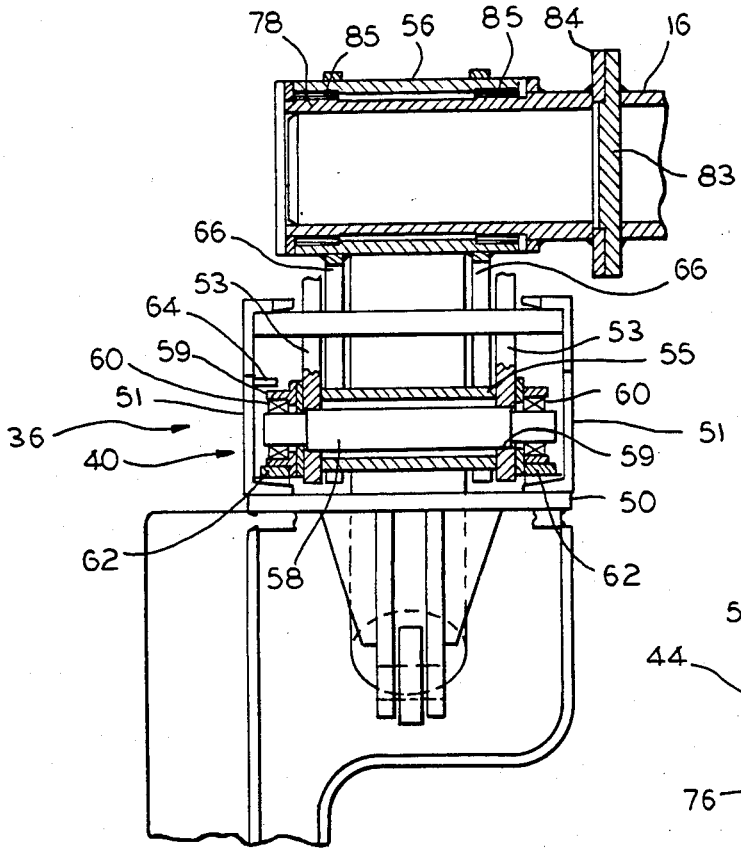
FIG. 5 is a view taken along lines 5—5 of FIG. 1.
Figure 7:
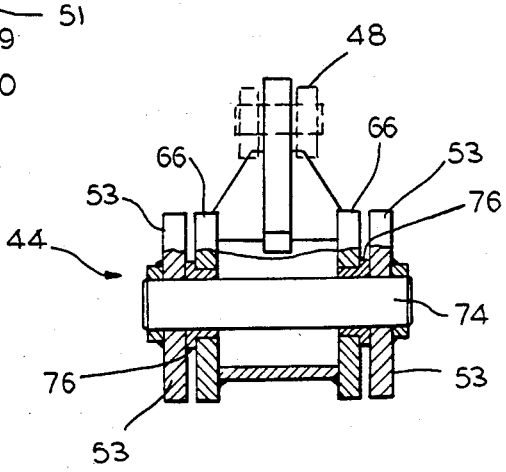
FIG. 7 is a view taken along lines 7—7 of FIG. 1.

The side frames 12 and 14 each include a main beam 36 and a pair of scissor beams 37 and 38. Each first scissor beam 37 is pivotally and slidably connected adjacent one end of its main beam 36 by a sliding pivot 40 and the lower end of the second scissor beam 38 is pivotally connected adjacent the other end of the main beam 36 by a fixed pivot 42. In addition, the scissor beams 37 and 38 are pivotally connected intermediate their ends by a third pivot 44. A hydraulic ram 45 is pivotally connected at its lower end to a first bracket 47 affixed below the main beam 36 and at its upper end to a second bracket 48 which is fixed to scissor beam 38 adjacent the pivot 44. The ram 45 is operative upon being pressurized to extend the scissor beams 37 and 38 from their collapsed position shown by full lines in FIG. 1 to an extended or operative position shown by broken lines. As seen in FIGS. 5 and 6, the main beam 36 is formed by a base plate 50 and a pair of channel beams 51 which are edgewise connected in an opposed, spaced apart relation to the base plate 50 to define a channel member which is opened at its upper end so that the scissor beams 36 and 37 may be received therein.

The scissor beam 37 comprises a pair of elongate, relatively flat members 53 which are joined in a parallel spaced apart relation by tubular end members 55 and 56 which extend therebetween. The pivot 40 is shown in FIG. 5 to include a pivot pin 58 concentric with the tubular member 55 and extending through aligned openings 59 in the members 53. Rollers 60 are mounted at the ends of the pivot pin 58 and each engages one of a pair of elongate wear bars 62 affixed to the inner surfaces of the channel beams 51 and in a parallel spaced apart relation to each other and adjacent the base plate 50. The wear bars 62 support the rollers 50 for movement between their full line positions shown in FIG. 1 and its broken line position. A guide bar 64 may also be affixed to the inner surface of one of the flanges 51 in a parallel spaced apart relation above the wear bar 60.

The second scissor beam 38 also includes a pair of elongate flat members 66 which are joined in a parallel spaced apart relation by tubular members 68 and 69. As seen in FIGS. 5 and 6, the spacing between inner surfaces of the members 53 is greater than that between the outer surfaces of members 66 so that the beam 38 may nestle within the beam 37 when the assembly is in its collapsed position as shown by full lines in FIG. 1.

The pivot 44 includes a pin 74 which whose ends are affixed to the members 53 and extend through aligned bearings 76 in the members 66.

The cross members 16 and 18 are elongate tubular members and are supported at their opposite ends by the sleeves 56 and 69 of the first and second scissor members, respectively. In particular, tubular members 78 are affixed to the ends of cross members 16 and 18 in any suitable manner such as by bolts (not shown) which secure mating flanges 83 and 84. Each member 78 is received supported by bearings 85 disposed within the sleeves 56 and 69.

Also affixed to cross member 16 and adjacent each of its opposite ends are pairs of aligned, short tubular members 86 each having a flange 88 at its outer end. A pair of similar flanges 89 are secured in spaced relation to each side frame 12 and 14. The spacing between the axes of members 86 is equal to that between the flanges 89 and the flanges have complementary bolt hole patterns.

For normal operations, the scissor beams 37 and 38 are movable between their extended state as shown in FIGS. 2 and 3 and by broken lines in FIG. 1. In addition to the cylinders 45, the beams 37 and 38 may be supported in their extended or transport position by pins 90 which extend through openings in the channel members 51 of the main beam 36 and brackets 92 affixed to each of the scissor members 53. For normal lifting operations, any suitable lifting mechanism such as the spreading arms 94 are suitably supported from the cross beams 16 and 18. This structure is conventional and therefore will not be discussed in detail for the sake of brevity. It will be sufficient for purposes of understanding the invention to state that the load is attached to the spreader arms 94 and then elevated, if desired, by extending the scissor beams 37 and 38.

Figure 4:
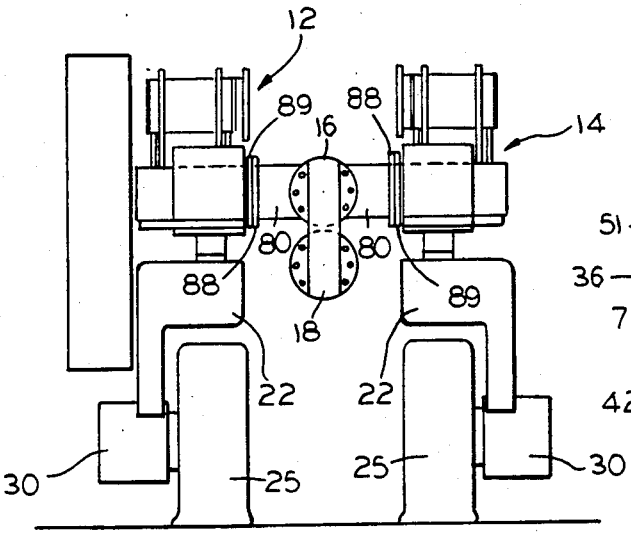
FIG. 4 is a front view of the crane of FIG. 1 in its collapsed state.

When it is desired to load the gantry 10 onto a transport aircraft, the scissor beams 37 and 38 are lowered by cylinder 45 from any elevated position to their position shown by full lines in FIG. 1. Pairs of support legs 98 are releasably attachable by pins 99 to the opposite sides of each of the side frames 12 and 14 and at each of then opposite ends. This permits the legs 98 to pivot in a vertical plane so that feet 100 at their lower ends just rest on the support surface. A cross member 101 may then be attached intermediate the ends of each of the support members 98 to provide a relatively rigid frame A-frame. When the side frames are supported in this manner, the bolts may be removed from each of the flanges 83 and 84 of cross members 16 and 18, which may then be placed aside. A fork lift or other device is then usd to elevate one of the side frames 12 or 14 and to move the same inwardly so that the spacing is reduced from that shown in FIG. 2 to that of FIG. 4. The cross beam 16 is then supported between the side frames 12 and 14 at which time the flanges 88 are bolted to the flanges 89. This provides a rigid assembly of reduced height and width as shown in FIG. 4. The remaining cross beam 18 may then be hung from beneath the cross beams 68, as also shown in FIG. 4. The assembled vehicle may then be driven onto the aircraft under its own power.

Hydraulic feed lines (not shown) may also extend along the main beams 36, between the members 53 of beam 36 and through the connecting members 16 and 18. These too must be disconnected during the compacting operation and reconnected to permit the crane to be driven onto and off of the aircraft.

I claim:

1. An air transportable mobile gantry crane having a pair of side frames, each side frame including a collapsible frame portion having an operating position wherein its upper end is elevated and a collapsed transport position wherein its upper end is lowered, elevating means for moving the collapsible frame portions between their elevated and collapsed positions, first and second cross connecting means each adapted to be releasably connectable to said side frames for joining the same in spaced apart relation, said first cross connecting means being relatively elongate to provide a substantial spacing between said side frames during normal operation and when said collapsible frame portions are extended, said second cross connecting means being relatively short to permit said side frames to be joined in close proximity to permit loading upon an aircraft when said collapsible frame portions are collapsed, said side frames each including a main beam means, said collapsible frame portions each comprising a pair of beam means pivotally mounted on said main beam means adjacent one end whereby their opposite ends may be elevated and lowered, said elevating means being coupled to said main beam means and said pivoting beam means, and coupling means on each of said pivoting beam means for coupling each of said first and second cross connecting means.

2. The air transportable mobile gantry crane as set forth in claim 1 and including a pair of wheel means mounted on each frame and power means for driving said wheel means whereby said gantry crane may be driven in both its operating and transportable modes.

3. The air transportable gantry crane as set forth in claim 2 wherein said first cross connecting means comprises a pair of elongate members each adapted to interconnect the upper ends of corresponding ones of the pivoting beams of each side frame, and said second cross connecting means comprises relatively shorter members.

4. The air transportable gantry crane as set forth in claim 3, wherein said second cross members extend integrally from one of said first cross members and adjacent the opposite ends thereof.

5. The air transportable gantry crane as set forth in claim 4 wherein said pivoting beam members are pivotally connected intermediate their ends and one of said beam members is pivotally and slidably mounted on said main beam.

6. The air transportable gantry crane as set forth in claim 5 and including auxiliary support means adapted to be mounted on each side frame for supporting the same while said cross connecting means are disconnected therefrom.

7. The air transportable mobile gantry crane as set forth in claim 1 and including a pair of wheel means mounted on each frame and power means for driving said wheels whereby said gantry crane may be driven in both its operating and transportable modes.

8. The air transportable gantry crane as set forth in claim 1 wherein said pivoting beam members are pivotally connected intermediate their ends and one of said beam members is pivotally and slidably mounted on said main beam.

9. The air transportable gantry crane as set forth in claim 1 and including auxiliary support means adapted to be mounted on each side frame for supporting the same while said cross connecting means are disconnected therefrom.

10. An air transportable mobile gantry crane including a pair of side frames, each side frame including a main frame portion and a pivoting frame portion having a pivoted operating position wherein its upper end is elevated and an unpivoted transport position wherein its upper end is lowered, elevating means for pivoting the collapsible frame portions between their elevated and collapsed positions, first and second cross connecting means each adapted to be releasably connectable to said pivoting frame portions for joining the side frames in spaced apart relation, said first cross connecting means being relatively elongate to provide a substantial spacing between said side frames during normal operation and when said collapsible frame portions are extended, said second cross connecting means being integral with said first cross connecting means and relatively short to permit said side frames to be joined in close proximity to permit loading upon an aircraft when said collapsible frame portions are collapsed, said pivoting frame portions comprising a pair of beam means pivotally mounted on said main beam portion adjacent one end whereby their opposite ends may be elevated and lowered, said elevating means being coupled to said main frame portion and said pivoting beam means, and coupling means on each of said pivoting beam means for coupling each to said first and second cross connecting means.

11. The air transportable gantry crane as set forth in claim 10 wherein said first cross connecting means comprises a pair of elongate members each adapted to interconnect the upper ends of corresponding ones of the pivoting beams of each side frame.

12. The air transportable gantry crane as set forth in claim 11 wherein said second cross members are affixed to and extend integrally from one of said first cross members and adjacent the opposite ends thereof.

13. The air transportable gantry crane as set forth in claim 12 and including auxiliary support means adapted to be mounted on each side frame for supporting the same while said cross connecting means are disconnected therefrom.

14. An air transportable mobile gantry crane having a pair of side frames, each side frame having a collapsible frame portion which includes pivoting beams and having an operating position wherein is upper end is elevated and a collapsed transport position wherein its upper end is lowered, elevating means for moving the collapsible frame portions between their elevated and collapsed positions, first and second cross connecting means each adapted to be releasably connectable to said side frames for joining the same in spaced apart relation, said first cross connecting means comprising a pair of elongate members each adapted to interconnect the upper ends of corresponding ones of the pivoting beams of each side frame to provide a substantial spacing between said side frames during normal operation and when said collapsible frame portions are extended, said second cross connecting means comprising relatively shorter members than said first cross connecting means to permit said side frames to be joined in close proximity to permit loading upon an aircraft when said collapsible frame portions are collapsed.

15. The air transportable gantry crane as set forth in claim 14 wherein said second cross members are affixed extend integrally from one of said first cross members and adjacent the opposite ends thereof.

* * * * *